US010087581B2

(12) United States Patent
Laitio et al.

(10) Patent No.: US 10,087,581 B2
(45) Date of Patent: Oct. 2, 2018

(54) ARRANGEMENT AND METHOD FOR TAIL-THREADING A FIBROUS WEB

(71) Applicants: Juha Laitio, Espoo (FI); Markku Nieminen, Vantaa (FI)

(72) Inventors: Juha Laitio, Espoo (FI); Markku Nieminen, Vantaa (FI)

(73) Assignee: TAKSO Software Ltd, Helsinki (FI)

( * ) Notice: Subject to any disclaimer, the term of this patent is extended or adjusted under 35 U.S.C. 154(b) by 0 days.

(21) Appl. No.: 14/994,322

(22) Filed: Jan. 13, 2016

(65) Prior Publication Data

US 2016/0215454 A1 Jul. 28, 2016

(30) Foreign Application Priority Data

Jan. 14, 2015 (FI) ..... 20150013

(51) Int. Cl.
*B65H 20/14* (2006.01)
*D21G 9/00* (2006.01)

(52) U.S. Cl.
CPC ..... *D21G 9/0063* (2013.01); *B65H 20/14* (2013.01)

(58) Field of Classification Search
CPC ..... D21G 9/0072; D21G 9/0063; D21F 7/04; B65H 23/24; B65H 23/245
See application file for complete search history.

(56) References Cited

U.S. PATENT DOCUMENTS 4,136,808 A 1/1979 Reba
4,785,986 A * 11/1988 Daane ..... F26B 21/004 242/615.11

(Continued)

FOREIGN PATENT DOCUMENTS

EP 1 002 898 A2 5/2000
FI 123973 B1 1/1979

OTHER PUBLICATIONS

FI10712 U (Valmet Technologies Inc [FI]) Dec. 5, 2014 (Dec. 5, 2014), Finland. This is special "utility model" that is also called as "petty patent". It is a special publication format and type in Finland. The whole document is valid, particularly from p. 4 line 16 to p. 5 line 16, from p. 6 line 28 to p. 7 line 3 and figures 2, 3a and 3.

*Primary Examiner* — Sean Michalski
*Assistant Examiner* — Fernando Ayala

(57) ABSTRACT

The primary object of the invention is an arrangement in the fibrous-web machine for tail-threading of a fibrous web, a tail-threading apparatus and a method for tail-threading. The arrangement comprises a tail-threading apparatus which is arranged to receive a tail separated from the fibrous web and to guide it further to the subsequent section of the fibrous-web machine in the longitudinal direction of the fibrous-web machine, at least one blower (102, 104) which is provided with a flow-preventing plate (103, 105) and arranged to guide the tail towards said tail-threading apparatus for feeding the tail to the tail-threading apparatus, whereby said at least one blower (102, 104) with its flow-preventing plate (103, 105) is arranged to divert the travel direction of tail on the longitudinal vertical plane and the cross-directional vertical plane of the fibrous-web machine, and said tail-threading apparatus comprises a rope nip receiving the tail the tail-threading ropes of which are supported by a rope pulley (108) which is arranged to rotate on a plane in the direction of the longitudinal axis of the fibrous-web machine and oblique in relation to the vertical direction and which is arranged to receive the diverted tail in the diverted travel direction. The invention enables the implementation of a tail-threading process fitting into a smaller space.

11 Claims, 11 Drawing Sheets

(56) References Cited

U.S. PATENT DOCUMENTS

| | | | | | |
|---|---|---|---|---|---|
| 4,837,946 | A * | 6/1989 | Hella | B65H 23/24 | 226/196.1 |
| 5,016,363 | A * | 5/1991 | Krieger | B65H 23/24 | 34/641 |
| 5,222,726 | A * | 6/1993 | Vits | B65H 23/24 | 226/196.1 |
| 5,230,165 | A * | 7/1993 | Beisswanger | B65H 20/14 | 34/420 |
| 5,317,817 | A * | 6/1994 | Roberts | B65H 23/24 | 226/196.1 |
| 5,639,303 | A * | 6/1997 | Plomer | D21H 23/72 | 118/218 |
| 5,762,284 | A * | 6/1998 | Rautiainen | B65H 19/1815 | 242/555.3 |
| 5,771,602 | A * | 6/1998 | Heikkila | D21H 25/06 | 34/114 |
| 5,922,407 | A * | 7/1999 | Hess | B05C 5/0283 | 118/305 |
| 6,073,825 | A * | 6/2000 | Hilker | D21G 9/0063 | 162/193 |
| 6,325,265 | B1 * | 12/2001 | Munch | D21G 9/0063 | 226/101 |
| 6,635,111 | B1 * | 10/2003 | Holtmann | B65H 23/24 | 118/325 |
| 9,387,131 | B2 * | 7/2016 | Andrews | A61F 13/15 | |
| 2002/0036071 | A1 * | 3/2002 | Mohrsen | B65H 20/10 | 162/193 |
| 2004/0079506 | A1 * | 4/2004 | Mohrsen | D21G 9/0072 | 162/255 |
| 2004/0129397 | A1 * | 7/2004 | Huhtala | D21G 9/0063 | 162/193 |

* cited by examiner

ARRANGEMENT AND METHOD FOR TAIL-THREADING A FIBROUS WEB

FIELD OF INVENTION

The invention relates to an arrangement and a method for tail-threading a fibrous web. Such an arrangement and method can be used in a fibrous-web machine and particularly in its tail-threading section during tail cutting and after it for conveying the tail to the subsequent sections of the fibrous-web machine and for starting the production of a fibrous web.

BACKGROUND OF INVENTION

Commonly in a fibrous-web machine, such as a paper or board manufacturing machine, tail-threading is performed at the normal run speed of the machine. Tail-threading is started from a point in which typically a full-width web is dropped down from a rotating machine element, such as a roll or a dryer, to broke handling, i.e. typically to a pulper or a broke conveyor, by cutting to the web a narrow tail suitable for tail-threading by special cutting devices, which tail also falls before the start of tail-threading to the broke handling similar to the other web. Disadvantageous rotating of the web and the tail around said roll is typically prevented by a doctor knife i.e. trailing knife on the roll surface. The tail-cutting devices affect the run of the tail by cutting it and by directing the new cut tip of the tail to a new path to be conveyed further by other tail-threading devices to a path of the web travelling through the subsequent section of the paper and board manufacturing machine. In this description, the roll side of the tail is referred to as the back side of the tail and the other side its front side. At the front side of the tail, a subsequent section of the paper and board manufacturing machine is located and the tail-threading is performed through it. When the narrow tail has been conveyed through said machine section, it is widened into a full-width web by moving the cutting device by which the tail was formed in the cross machine direction.

There are many and different known tail-cutting devices because the run speed of the fibrous-web machine and the properties of the fiber to be cut, such as paper or board, set very different requirements for the cutting device. The difference between paper and board is not strict but commonly boards are thick and thus flexurally stiff compared with paper. Often, the speed of paper machines is also higher than that of board machines.

One type of a cutting device in a paper machine is an air cutting device, by means of which, the tail is released from the surface of the rotating roll before said point in the knife of the doctor knife by blowing air by the so-called releasing blow between the tail and the roll. In the release point of the tail, there is simultaneously arranged a narrow gap between the air cutting device and the roll, whereby the loop of the tail releasing from the roll surface hits the corner of the air cutting device and the upper surface of the device. Close to the corner and on the upper surface of the device, there is arranged an intensive blow blowing away from the roll and the tail falls within the range of a vacuum created by this blow. This blow, which often referred to as the cut-off blow, is typically provided by means of compressed air discharging via a row of holes from a nozzle chamber. The discharging air causes an intensive vacuum at the point of the nozzle holes and the tail is sucked fast in the strongly turbulent nozzle flow which breaks the tail i.e. simultaneously cuts said loop of the tail and the connection between the tail and the tail section going to broke handling. The cut new tip of the tail starts to run in the direction of the cut-off blow and towards the subsequent tail-threading devices. In practice, the operation of the device has been boosted by arranging a similar intensive air blow close to the tail such that the blow aims at conveying the moving tail into the direction preceding cutting towards broke handling. This blow, which is often referred to as a holding-down blow, is positioned in the travel direction of the tail after the said forming loop of the tail and, when the loop enters within the range of the vacuum of cut-off blow, the holding-down blow forms in the tail a force affecting in the opposite direction in relation to the cut-off blow, which in the best case momentarily stops the tail having previously travelled at the run speed of the paper machine. The tail having stopped at the point of the nozzle of the cut-off blow is cut considerably more quickly than the moving tail. The functionality of this type of a cutting device becomes weakened as the rigidity of paper increases and generally this device is not suitable for cutting board. A more rigid tail will not be released into a loop from the surface of the rotating roll by means of the release blow and the tail will not curve sufficiently to enter within the range of the vacuum of the cut-off blow nozzle.

In board machines, the tail is typically cut between various cutting knives or by guiding the tail against rotating knives. In cutting devices, there is typically a turning cut-off plate, at the tip of which there is the other half of the cut-off knife pair, on the same side of the tail as said rotating roll of which the tail will fall down towards broke handling i.e. on the backside. Before the cutting event, the cut-off plate is directed substantially towards broke handling thus disturbing the run of the tail as little as possible. As the cut-off plate typically turns forward and upward towards the subsequent tail-threading devices at the front of the tail, the cut-off knife of the cut-off plate tip passes by a stationary counter knife, whereby the tail is cut between the knives and the connection between the tail and the tail section going to broke handling is cut.

Another typical structure used is a turning cut-off plate without the knife at its tip when there are quickly rotating knives in place of the counter knife. The cut new tail tip starts travelling into the direction according to the position of the cut-off plate after the cutting moment towards the subsequent tail-threading devices. Typically, there are arranged air blows before the cut-off plate above it, to the cut-off plate itself and after the stationary counter knife, from the effect of which air blows, the travel of the cut tail into the desired direction is more reliable. Due to the location of the device on the same side as the moving roll i.e. at the backside of the tail, the device must be typically located disadvantageously below the doctor knife of the roll. In some cases, lack of available space still prevents the location of the cutting device below the doctor knife, whereby alternative ways must be introduced. However, board cutting has been proved most reliable by devices of the type described above and devices located above the doctor knife are avoided if possible. Such an alternative solution is a combination of a miniature doctor knife, a holding-down blow and a stationary cut-off knife being at its tip pushing under the tail along the roll surface. The cutting is performed in the way of scissors by means of a cut-off knife turning from the front of the tail. It is also typical of known cutting devices that there is precisely designed timing of different blows and motions in relation to each other, which enables their automatic operation.

The cut tail is guided to a section receiving it which is typically located at least partially outside the full web width in the lateral direction of the machine from which it is further brought to the subsequent handling section of a full-width web in the machine to web conveying devices before it is widened into a full-width web. One such a tail-threading apparatus is a rope nip described in specification FI123973. In the method described in the specification, the direction of the tail is diverted in relation to the longitudinal axis of the fibrous-web machine and the tail is received by a rope nip in which the travel direction of tail-threading ropes corresponds substantially the diverted incoming direction of the tail. In practice, a rope pulley of the rope nip has been rotated around the vertical axis such that its rotation plane is vertical but at an angular position compared with the longitudinal vertical plane of the fibrous-web machine. The diversion of the direction of the tail again occurs typically by rotating it around the vertical axis when it falls from a roll preceding the tail-threading and by guiding it further straight obliquely aside from the machine direction at an angle to which it has rotated. However, such an arrangement takes quite a lot of space in a fibrous-web machine.

As a summary, it can be stated that known cutting devices particularly designed for board require a lot of space in the tail-threading section of a fibrous-web machine and are thus awkward to locate or, on the other hand, are relatively complex to implement. Known arrangements for receiving a cut tail and bringing it to the subsequent sections of the machine again take quite a lot of space in the fibrous-web machine.

Therefore, there is requirement for improved manipulation devices of fibrous webs and particularly for cutting devices of board webs in the tail-threading section of a board machine.

SUMMARY OF INVENTION

A primary object of the invention is to provide an improved arrangement and tail-threading apparatus for conveying a tail of a fibrous web to the subsequent sections of the machine. Especially, the object is to achieve an arrangement which can be implemented in a smaller space compared with known arrangements. The object is also to provide an equivalent method.

A second object is to introduce a device for manipulating fibrous webs and particularly relatively rigid board webs. A particular object is to provide an air cutting device simpler than known arrangements. A further object is also to provide a device which fits into a smaller space than known arrangements and/or a device which can be more freely located in the tail-threading apparatus of a fibrous-web machine, particularly a board machine.

A third object is to introduce a combined tail-cutting and tail-threading arrangement which comprises an air tail-cutting device and an arrangement for conveying the tail to the subsequent sections of the machine.

The object of the invention is also to provide equivalent methods for manipulating a fibrous web, particularly for cutting it for tail-threading and/or conveying the tail to the subsequent sections of the machine.

Arrangement for Tail-Threading

The arrangement according to the invention is based on the idea that, after tail cutting, the tail is brought within the range of at least one blower, whereby said at least one blower is provided with a flow-preventing plate which is arranged to divert the travel direction of the tail simultaneously substantially on two different planes, particularly on the vertical plane in the longitudinal machine direction (i.e. machine direction) and on the vertical plane in the cross machine direction. The blower comprises advantageously a so-called holding-down blower the flow-preventing plate of which is shaped asymmetric different from known arrangements. Typically, after the holding-down blower there has been arranged a second blower, a so-called draw-in blower, which also comprises an asymmetrically shaped flow-preventing plate.

The arrangement according to the primary aspect of the invention for tail-threading a fibrous web in a fibrous-web machine comprises a tail-threading apparatus which is arranged to receive a tail separated from the fibrous web and to guide it further in the longitudinal direction of the fibrous-web machine to the subsequent sections of the fibrous-web machine, and at least one blower which is provided with a flow-preventing plate and arranged to guide the tail towards said tail-threading apparatus for supplying the tail to this after tail cutting. Said at least one blower with its flow-preventing plate is arranged to divert the travel direction of the tail substantially into an angular position in relation to both the horizontal and the vertical direction and said tail-threading apparatus is arranged to receive the diverted tail in said diverted travel direction. Advantageously, said angular position is 30-60 degrees.

According to the invention, the blower with its flow-preventing plate is arranged to divert the travel direction of the tail, which is typically substantially straight downwards when cut, further in the machine direction for at least 135 degrees. Thus, its direction when supplying to the tail-threading apparatus diverts for at the most 45 degrees from the vertical plane in the cross machine direction seen from the side of the machine. Advantageously, the diversion occurs substantially to the vertical plane in the cross machine direction, whereby a component projected on the longitudinal vertical plane of the fibrous web of the travel direction of the tail diverts in the arrangement substantially for 180 degrees seen in the longitudinal machine direction if the travel direction of the tail is downwards from the top, as usual, when cutting it. When conveying to the tail-threading apparatus, such as a rope nip, the direction is thus at least partially from the top downwards and, furthermore, it has a component in the lateral direction of the fibrous-web machine.

Particularly advantageously, the diversion of the travel direction is provided with one or more blowers the flow-preventing plate of which is deflected asymmetrical i.e. into an angle diverting from the machine direction such that they provide, together with the blow arranged into their vicinity, simultaneously both a machine-directional and a cross-directional change in the direction of the tail.

Equivalently, the tail-threading apparatus according to the invention for receiving a cut tail in the tail-threading section of a fibrous-web machine comprises means for receiving the tail substantially at an angular position in relation to the longitudinal direction and/or the horizontal cross-direction and/or the vertical cross-direction of the fibrous-web machine and means for diverting the travel direction of the received tail substantially into the machine direction. According to the invention, the means for receiving the tail are arranged to receive the tail which approaches it substantially at an angular position in relation to the vertical and the horizontal direction and advantageously substantially on a vertical plane in the cross machine direction or diverting from this at the most 45 degrees.

In a method according to the invention a tail is separated from a fibrous web, the tail is fed substantially downwards from the top, the tail is cut, the cut tip of the tail is guided by means of at least one blower provided with a flow-preventing plate to a tail-threading apparatus which is arranged to receive the tail and to guide it further to the subsequent sections of the fibrous-web machine in the longitudinal direction of the fibrous-web machine, whereby when guiding the tail to the tail-threading apparatus, its travel direction is changed at least substantially in two different dimensions, whereby the change of the travel direction is at least partially based on the shape of the flow-preventing plate of said at least one blower.

In more detail, the arrangement and the tail-threading apparatus according to the invention are characterized in what is stated in the independent claims.

The invention provides considerable advantages. Particularly, the tail-threading arrangement can be fit in a considerably smaller space than known arrangements. This is provided by a novel geometry in which the tail converges with the device section receiving it, particularly a rope nip. The required space can be minimized before this converging point because the rotation and transfer of the tail occurs as part of the holding-down blow and the tail conveyance after that. The holding-down blow and tail conveyance towards the rope nip are necessary in any case and the invention utilizes these stages in the diversion and transfer when, in known arrangements, particularly the diversion stage has been performed as a separate stage before the holding-down blow. Particularly for this reason, the present arrangement can be located in its totality upper in the fibrous-web machine than the known arrangements, i.e. closer to the tail-threading roll and farther from the broke-handling apparatus, whereby there is, inter alia, more service space or other device space in the machine.

The arrangement comprises most advantageously only two blowers, one of which is a holding-down blower, whereby the space required by the arrangement is also very small in the longitudinal direction of the machine. In known arrangements, there can have been several blowers or other manipulation devices between the holding-down blow and the rope nip whereas, in the present arrangement, there is most advantageously between them only one blower, the so-called draw-in blower, which includes an obliquely deflected flow-preventing plate.

The advantage of flow-preventing plates deflected obliquely for the present purpose, originally being planar, is that the tail is all the time 'in an ideal state' i.e. no great stresses apply to it. It is thus naturally reversibly deflected, such as paper or board naturally deflects without tearing or other permanent damage.

The dependent claims deal with some advantageous embodiments.

According to an embodiment, the arrangement comprises at least one first blower which is provided with a first flow-preventing plate and arranged to guide a tail separated from the fibrous web towards the tail-threading apparatus, and at least one second blower which is provided with a second flow-preventing plate and arranged to guide said tail further from the first blower towards the tail-threading apparatus. Furthermore, the fibrous web is arranged to run at least partially on the lower surface of the first flow-preventing plate and at least partially on the upper surface of the second flow-preventing plate. This enables an apparatus fitting into a particularly small space and being simple.

According to another embodiment, the first blower and flow-preventing plate are arranged to divert the travel direction of the tail from the vertical direction substantially directed from the top downwards to substantially horizontal and at an angle in relation to the longitudinal axis of the fibrous-web machine, and the second blower and flow-preventing plate are arranged to divert the travel direction of the tail further substantially on a plane in the cross direction of the fibrous-web machine and at an angle opening obliquely upwards.

According to a further embodiment, the shape of the flow-preventing plate of said at least one blower corresponds to that of a deflected planar plate and the tail is arranged to run substantially following the surface of the flow-preventing plate, whereby the change in the travel direction of the tail occurs in the natural geometry of the tail. This means that no such shearing forces are applied to the tail on its plane or against its plane which could cut or locally break it. This is ensured by that also the flow-preventing plates are deflected in a three-dimensional form desired in the natural plate geometry.

According to an embodiment, the tail-threading apparatus is arranged to divert the travel direction of the received tail substantially into the machine direction, advantageously in the direction of the longitudinal axis of the fibrous-web machine, and to rotate the tail around the machine-directional axis substantially onto the machine level, advantageously horizontally around said longitudinal axis. The diversion can be performed on a rope path of the rope nip simultaneously as it is conveyed forward, towards the conveying means of the main web, whereby also this stage requires no extra space.

According to another embodiment, the tail-threading apparatus comprises a rope gap diverted equivalently with the tail, i.e. a rope nip receiving the tail, the tail-threading ropes of which are supported by at least one rope pulley which is arranged to rotate on a plane in the direction of the longitudinal axis of the fibrous-web machine. Particularly, the rotation axis of the rope pulley can be located on a vertical plane of the cross fibrous-web machine direction and be at an angular position in relation to the horizontal plane.

Advantageously when guiding the tail to the tail-threading apparatus, it is guided onto the lower surface of the flow-preventing plate of the first blower where the travel direction of the tail changes in the machine direction for at least 60 degrees, advantageously about 90 degrees, at least partially due to the shape of the flow-preventing plate. Furthermore, there can occur a change of direction aside from the original travel direction (in cross machine direction) e.g. for at least 5 degrees at least partially due to the shape of the flow-preventing plate.

Furthermore advantageously when guiding the tail to the tail-threading apparatus, it is guided further onto the upper surface of the flow-preventing plate of the second blower where the travel direction of the tail changes in the machine direction further for at least 45 degrees, advantageously about 90 degrees, at least partially due to the shape of the flow-preventing plate. Furthermore, there can also occur a change of direction aside from the original travel direction (in cross machine direction) e.g. for at least 5 degrees at least partially due to the shape of the flow-preventing plate.

The flow-preventing plates can be asymmetrically deflected metal plates.

Air Cutting Device

According to a second aspect of the invention is provided a web manipulating device, particularly an air tail-cutting device, whereby the idea is to utilize the gas flow, typically air flow, of a blower guiding the fibrous web in order to increase friction in a friction element located in the vicinity of the blower against which element the fibrous web is pressed when the blower operates. Particularly, a friction element is utilized which is provided with a flow-preventing element, such as a flow-preventing plate, located in the vicinity of blow openings of the blower, which friction element is arranged to create a vacuum between the friction element and the fibrous web. The vacuum is provided by the flow-preventing plate of the blower which prevents the supply of make-up air from the other side of the blow openings seen from the web and, on the other hand, by a surface profile of the friction element which allows an air flow directed mainly in the direction of the blow from the area of the friction element. In other words, the blower creates suction directed at the friction element in the fibrous web. Particularly, the surface profile can be such that the friction element forms a discontinuous contact with the fibrous web, whereby there remains an air channel or air channels between it and the fibrous web. Hence, a continuous vacuum can thus be provided i.e. it stays on also when the fibrous web is pressed against the friction element. Particularly, the friction element and the blower are located such in relation to each other that the blow is substantially directed away from the friction element.

The device according to the second aspect of the invention comprises at least one blower provided with a flow-preventing element which is arranged to produce at least one blow, typically an air jet, at least mainly in the direction of the fibrous web against the plane of the fibrous web in order to apply a perpendicular force component to the fibrous web, and a friction element against which the fibrous web is arranged to be pressed partially from the effect of said force component to apply friction force resisting the motion of the fibrous web to the fibrous web. The friction element comprises a surface profile which is shaped such that said at least one blow causes a vacuum on the surface of the fibrous web being on the side of the friction element, typically between the fibrous web and the friction element. The vacuum intensifies the pressing of the fibrous web against the friction element and thus further increases said friction force.

In the method according to the second aspect of the invention, the fibrous web is conveyed in the vicinity of at least one blower such that the blow produced by the blower produces a force component to the fibrous web perpendicular against the plane of the fibrous web, and friction force resisting its motion is applied to the fibrous web by a friction element having such a surface profile and which is located in the vicinity of said blower such that the blow creates a continuous vacuum on the surface of the fibrous web on the side of the friction element.

In this context, manipulating the fibrous web particularly refers to the guiding, tightening, decelerating, stopping and/or cutting of the fibrous web or its part.

The air cutting device described here offers considerable advantages. First, because the fibrous web is pressed against the friction element due to the vacuum with a greater force, friction between them increases, which enables more efficient manipulation of the fibrous web particularly in the tail-threading process. For the same reason, the invention is also applicable for manipulating board webs which are more rigid than paper webs and thus less guidable. Second, it is possible to implement by means of the second aspect of the invention an air cutting device fitting into a smaller space. Particularly, the whole device assembly cutting the fibrous web can be implemented as one unit as later will be described. Third, a tail-threading apparatus or some other manipulation apparatus of a fibrous web, a part of which the present device is in each case, can be provided considerably simpler. The device can be totally located on one side of the web, which simplifies the apparatuses.

The device according to the second aspect of the invention can thus be used as an arrangement in the tail-threading section of the fibrous-web machine as part of the tail-threading apparatus. By means of it, a rigid board web can be cut by sole air blows in the purpose of tail-threading. The advantage of the arrangement is that board can be cut by only using air blows instead of mechanical moving knives, which in addition to being simple also increases safety. The apparatus can be implemented light-structured compared with arrangements cutting by means of knives. Particularly, it can be located relatively high in relation to the roll from which the tail falls, even on the level of the doctor knife or above it.

The invention is also applicable for manipulating and particularly cutting paper webs in addition to board. The second aspect of the invention is particularly advantageously applicable for manipulating a board web, the previously known arrangements used for the manipulating of which have been complex and/or large-sized.

Definitions

'In the direction of the fibrous web' refers here to the machine direction. The motion or travel direction of the fibrous web refers to the direction of the fibrous web into which the web proceeds and the opposite direction to the motion or travel direction refers to its opposite direction. The width refers here to the perpendicular direction to the machine direction on the plane of the web.

The direction of the longitudinal axis of the fibrous-web machine refers to the direction between the forward end and the tail end of the machine. The lateral machine direction or cross machine direction refer to a horizontal direction perpendicular to the direction of the longitudinal axis. The vertical direction refers to a direction perpendicular to the longitudinal axis direction and the lateral direction. The cross-directional vertical plane refers to a plane perpendicular to the longitudinal axis of the machine. The longitudinal vertical plane refers to a plane perpendicular to the cross direction.

Blows arranged 'substantially' or 'at least mainly' in the direction of the fibrous web (or in its motion direction or against its motion direction) refer to blows deviating at the most 45 degrees from the direction in question on the plane of the fibrous web and/or out of its plane. Here, the reference is to the start direction of blows (the direction in the immediate vicinity of the blow nozzles). The blows can change direction ('be curved') e.g. due to air controls and/or the Coanda effect.

The blow being directed substantially away from the friction element refers to a situation in which most part of the friction element, advantageously the whole friction element, is located on the backside of a plane defined by the outlet opening/openings and start direction of the blow, i.e. on the other side to that to which the blow is directed.

A flow-preventing element refers to an element which prevents the supply of make-up air in the vicinity of the blow from the side of blow openings opposite to that where the web and the friction element are located. Such an element is particularly a plate arranged in the vicinity of the blow opening in the start direction of the blow or advantageously at the most 45 degrees deviating from this direction. The term flow-preventing plate (or element) equals here a flow-control plate (or element) or a Coanda plate (or element), because the guiding of flow is based on the free blow flow being prevented due to the plate at least partially and the flow thus tends to be guided in the direction of the plate particularly due to the so-called Coanda effect.

A vacuum on the surface of the fibrous web on the side of the friction element (the front surface) refers to pressure smaller than the one prevailing on its opposite surface (the back surface) which is caused at least partially from the combined effect of air jet(s) in the direction of the fibrous web and the mutual location(s) of the friction element and the surface profile of the friction element. The vacuum causes the intensified pressing of the web against the friction element.

Next, the embodiments of both the aspects of the invention and their advantages will be described in more detail with reference to the attached drawings.

DETAILED DESCRIPTION OF EMBODIMENTS

Arrangement for Tail-Threading

Below will be described an embodiment of the present arrangement in which the diversion of the travel direction of a tail is provided by rotating the tail by utilizing natural deflection after a holding-down blow nozzle. To recap, the tail originally travelling downwards on the vertical plane is diverted to travel finally on the vertical plane and at an angle in relation to the vertical direction and aside in relation to the original position in the cross machine direction. The tail is conveyed to an equivalently inclined rope nip.

Figure 5A:
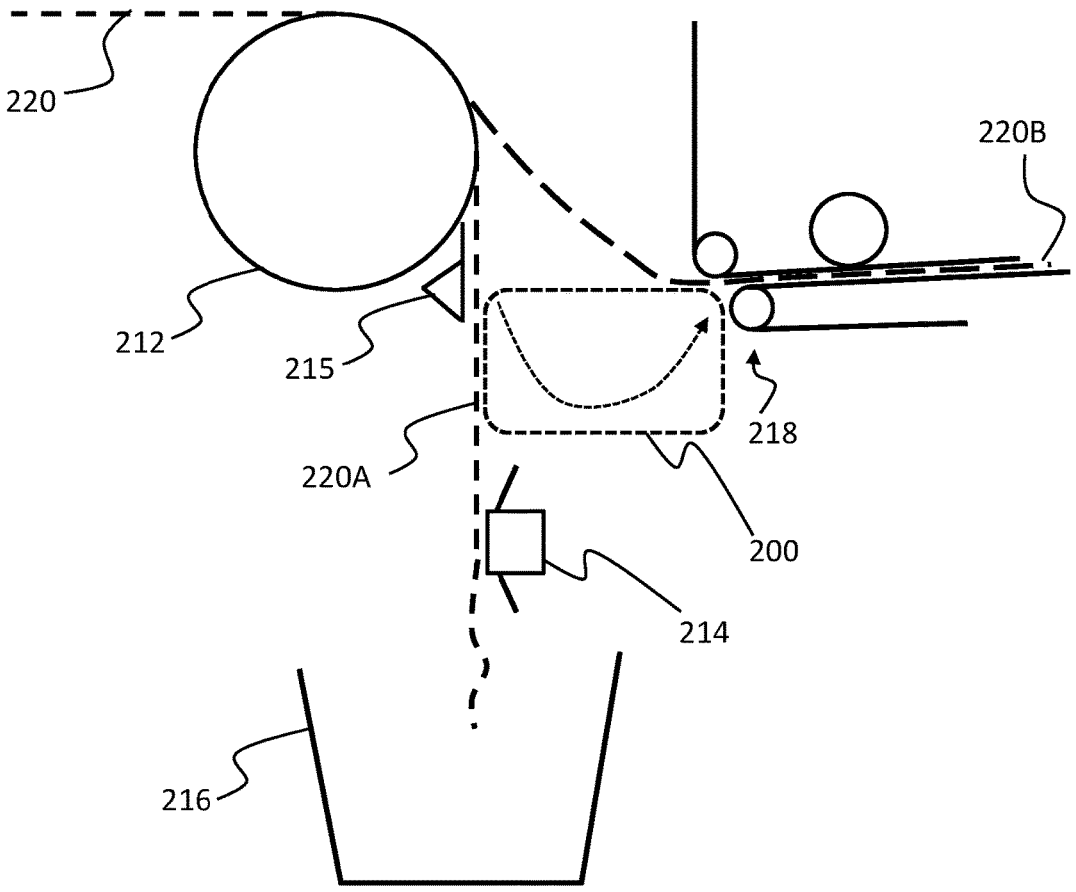
FIGS. 5A and 5B show a cross section of the basic principle of a tail-threading arrangement according to the second aspect of the invention on the longitudinal vertical plane of the fibrous-web machine.

FIG. 5A shows the basic principle of tail-threading in a paper or board machine. A fibrous web 220 is supplied onto a roll 212 from which it falls into a broke-handling device 216, such as a pulper. The web releases from the roll 212 at the latest when hitting a doctor knife 15. A tail 220A has been separated from the web by cutting it before the web releases from the roll 212. The tail is cut by a cutting device 214, such as an air cutting device to be described below in more detail.

FIG. 5A also shows the situation after cutting when a tail 220B has been cut first by the air cutting device 214 and brought to a rope nip 218 or some other apparatus controllably receiving the tail 220B for guiding it to further processing. The present tail-threading apparatus, such as the rope nip, is designated with reference number 218 and the present arrangement primarily involves device sections between the cutting device 214 and further processing, i.e. an intermediate draw apparatus 200 and the tail-threading apparatus 218.

Figure 5B:
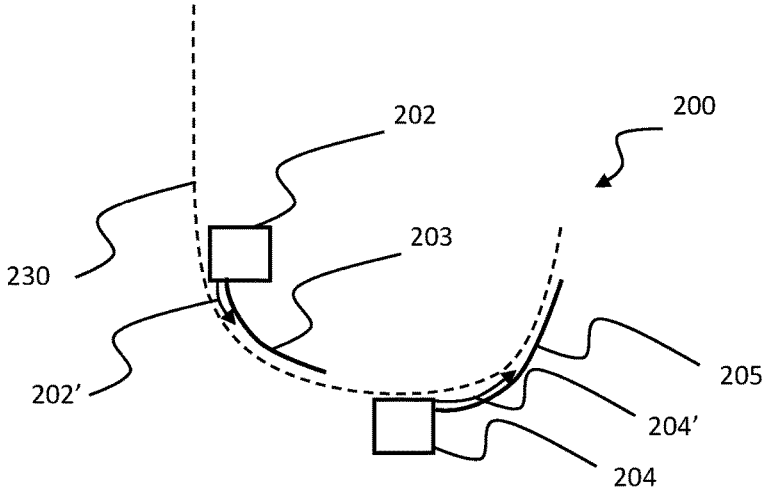

FIG. 5B shows in more detail the intermediate draw apparatus 200 according to an embodiment. The tail separated from the roll 212 and cut is guided downwards from the vicinity of a holding-down blower 202. The holding-down blower 202 comprises a flow-preventing plate deflected curved in the direction of the tail-threading apparatus, i.e. a Coanda plate 203. A blow 202' is directed downwards from the area between the flow-preventing plate 203 and the tail 230, whereby it curves due to the Coanda effect towards the flow-preventing plate 203 also guiding the fibrous web into this direction. The holding-down blower 202 guides the fibrous web 230 to a draw-in blower 204, whereby the fibrous web transfers from the lower surface of the flow-preventing plate 203 of the first blower to the upper surface of an at least partially upwards-curved flow-preventing plate 205 of the second blower. A blow 204', which is advantageously directed originally in the horizontal direction, conveys the fibrous web in the direction of the surface of the plate 205 thus guiding it finally upwards or obliquely up, like described below in more detail.

The flow-preventing plates 203, 205 are deflected, in addition to the direction shown in FIG. 5B, also in the direction perpendicular to the plane in the figure such that they provide the lateral displacement of the tail away from the width and travel path of the main web. The later figures illustrate the deflection of the plates, lateral displacement and the incidence angle of the tail to the rope nip or some other tail receiving and drawing-in apparatus. Hence, simultaneously as the blowers 202, 204 guide the fibrous web on the longitudinal plane of the machine, they also guide it on the cross-directional plane of the figure towards the actual tail-threading apparatus 218 which is located aside from the actual web area.

Figure 7:
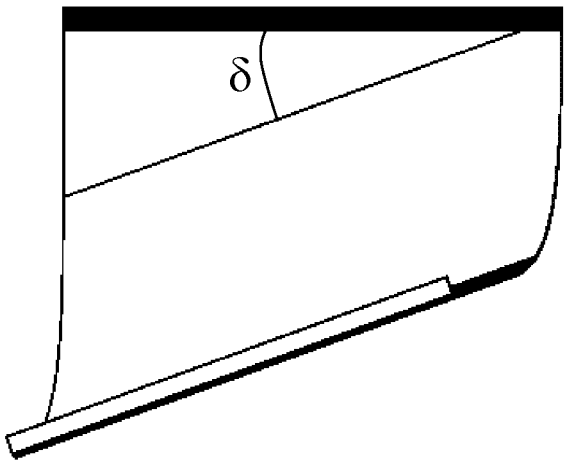
FIG. 7 shows a conceptual drawing of a deflected flow-preventing plate suitable for the present arrangement.

FIG. 7 shows a deflected flow-preventing plate suitable for use in the holding-down blower 202 and the draw-in blower 204. The shape of the plate is substantially rectangular but, as seen from the figure, the plate has not been deflected symmetrically straight against the original plane of the plate but the deflection has been started at an angle δ in relation to that end of the plate from which direction the fibrous web is brought into its vicinity by means of the blow. The angle δ can be e.g. 5 . . . 45 degrees. In this way, the shape of the plate is provided which further provides the simultaneous guidance of the web in both the machine direction and the cross direction. In the machine direction, the deflection angle is advantageously 60 . . . 90 degrees, particularly 90 degrees, whereby the combined deflection angle of two successive plates is 180 degrees. Then, the tail changes its travel direction in the machine direction to the opposite in relation to the original direction. It is possible to use similar plates in the holding-down blower 202 and the draw-in blower 204, but they can also be deflected in a different way. The plates can also include straight sections or operationally similar curvature can have been provided in parts by means of straight partial plates e.g. by bending or welding.

The diversion of the tail is thus performed most advantageously by deflected blow plates in accordance with FIG. 7 the deflection of which has been done at an oblique angle in relation to the straight side of the plate. This angle together with the other geometry of the plates determines finally the travel direction of the tail in relation to the vertical direction and thus also the ideal inclination angle of the rope nip. There are most advantageously two plates and they have been reserved their own blowers to ensure tail-conveying security and to provide sufficient changes in direction. The lateral displacement of the centre line of the tail if affected by all deflection parameters (also deflection radius R or partial angles and gaps in deflection in parts) and possible straight sections in the plates and the distance between the plates. The geometry is adjusted to equal the actual distance of the rope line from the original path of the tail to provide the desired lateral displacement.

Figure 6A:
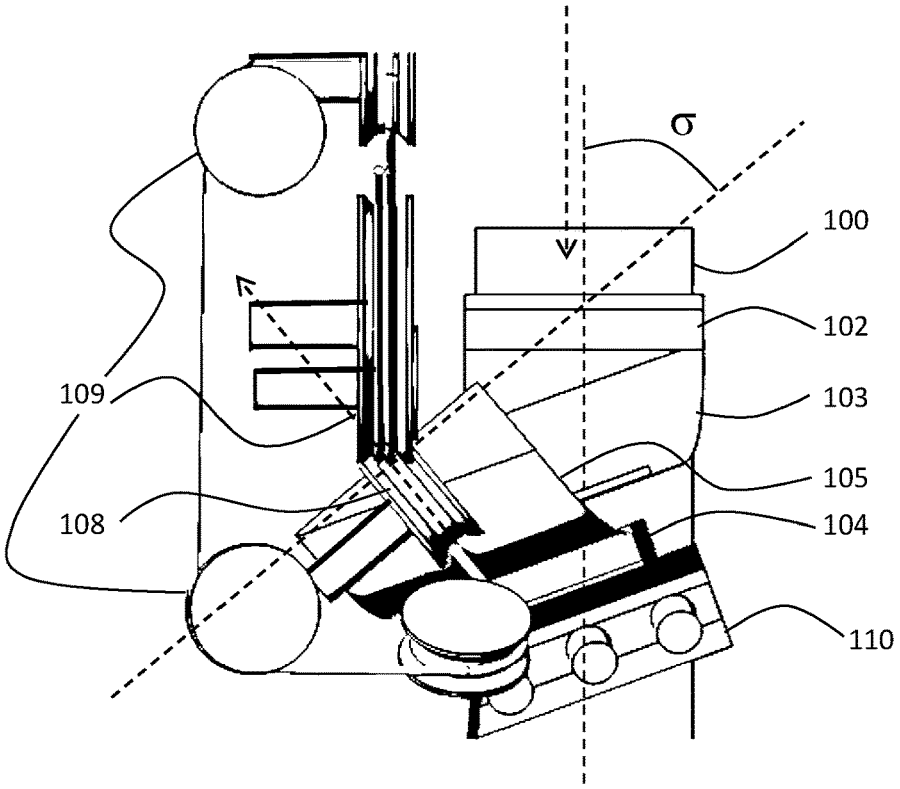
FIGS. 6A, 6B and 6C shows a cross-directional vertical planar view, a longitudinal vertical planar view and a horizontal view of the fibrous-web machine, respectively, of the present tail-threading arrangement according to an embodiment.
Figure 6B:
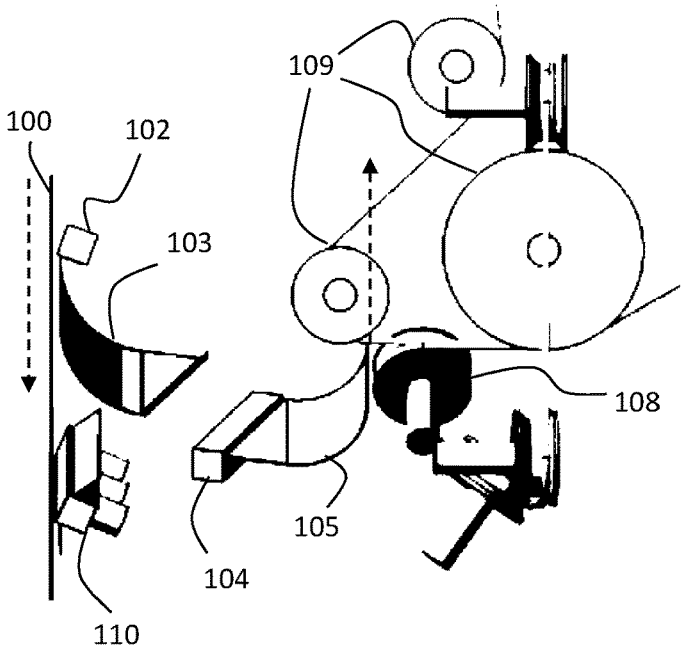
Figure 6C:
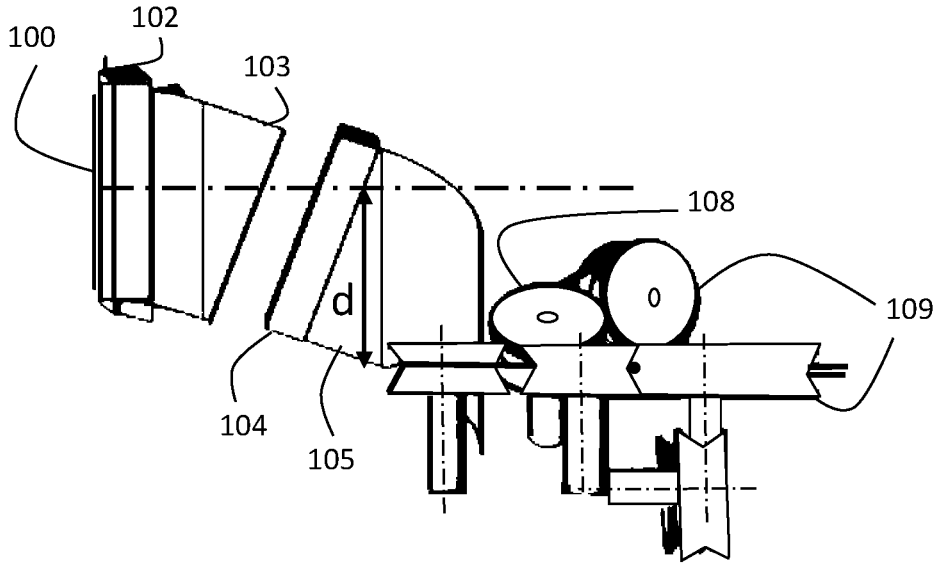

According to an embodiment, the arrangement includes the holding-down blower 202 and the flow-preventing plate 203 connected to it above the web, the draw-in blower 204 and the flow-preventing plate 205 connected to it below the web and the rope nip 218 receiving the web at least one rope pulley of which is arranged into an angular position. FIGS. 6A-C illustrate in more detail such an embodiment as views from different directions.

FIG. 6A shows a projection in the direction of the longitudinal axis of the machine (seen from the tail end to the forward end of the machine) of the most important parts of the arrangement. A fibrous web 100 coming from the top is guided into the vicinity of a holding-down blower 102. A flow-preventing plate 103 of the holding-down blower is deflected in a way shown in FIG. 7 and described above towards the tail end of the machine and aside from the direction of the longitudinal axis of the machine. The fibrous web 100 follows the lower surface of the plate 103 towards a draw-in blower 104 and further on the upper surface of its flow-preventing plate 105 deflected in the same way towards a rope nip which comprises a rope pulley 108 having been diverted at an angular position equivalent to the incoming direction of the fibrous web in the crosswise vertical plane of the machine. Dashed arrows show the incoming and outgoing directions of the tail to/from the blowers 102, 104. The rope nip is thus inclined around a horizontal axis in the longitudinal direction of the machine at the same angle as the incidence angle of the tail in the cross-directional vertical plane of the machine. Other rope pulleys in the rope path of the rope nip are designated with reference number 109. The incoming direction of the tail to the rope nip is advantageously in the cross-directional vertical plane of the machine and at an angle in relation to the vertical direction. The complement of this angle, i.e. simultaneously the angle between the cross direction and the vertical direction of the tail of the flow-preventing plate 105 of the draw-in blower, is designated by symbol $\sigma$ in FIG. 6A. The angle $\sigma$ can be e.g. 10 . . . 80 degrees, typically 30 . . . 60 degrees. The tail-cutting device is designated by reference number 110 in the figure.

FIG. 6B shows a projection in the direction of the cross-directional horizontal axis of the machine of an arrangement equivalent to FIG. 6A. Dashed arrows show the incoming and outgoing directions of the tail to/from the blowers 102, 104. According to the figure, the angular difference of these directions on the plane of the figure can be 180 degrees. In the shown arrangement, the tail arrives to the tail-threading ropes at an angle of 90 degrees, but the angle can have been adjusted also greater, e.g. 90 . . . 135 degrees.

FIG. 6C illustrates a change in the position of the centre line of the tail in the cross machine direction, i.e. the lateral displacement. The lateral displacement d can be e.g. 5-50 cm. The width of the tail can be e.g. 5-20 cm. The blowers 102, 104 and the flow-preventing plates 103, 105 are advantageously of the same width or wider than the tail.

Figure 8A:
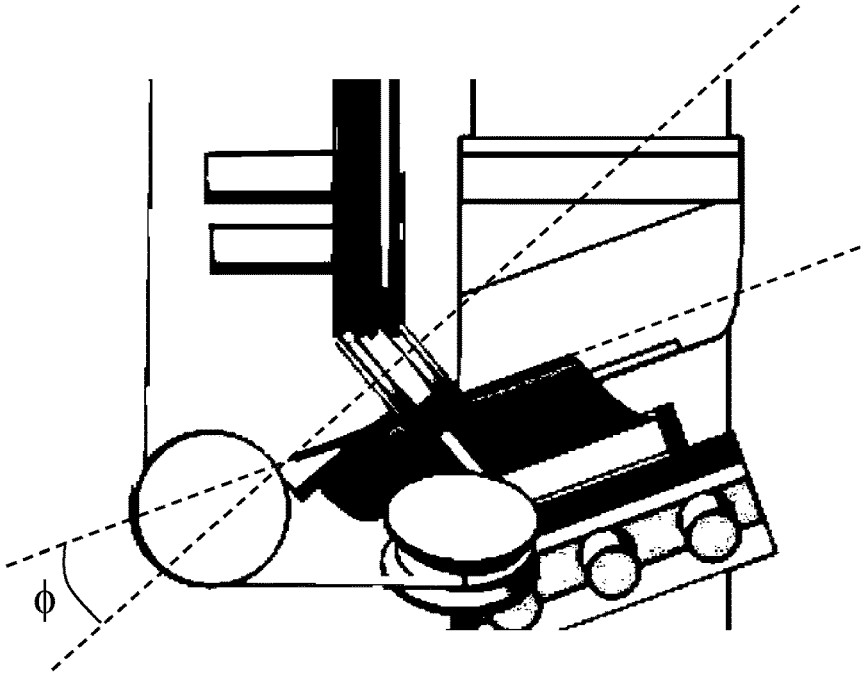
FIGS. 8A and 8B show views corresponding the views of FIGS. 6A and 6B of variations of the present tail-threading arrangement.
Figure 8B:
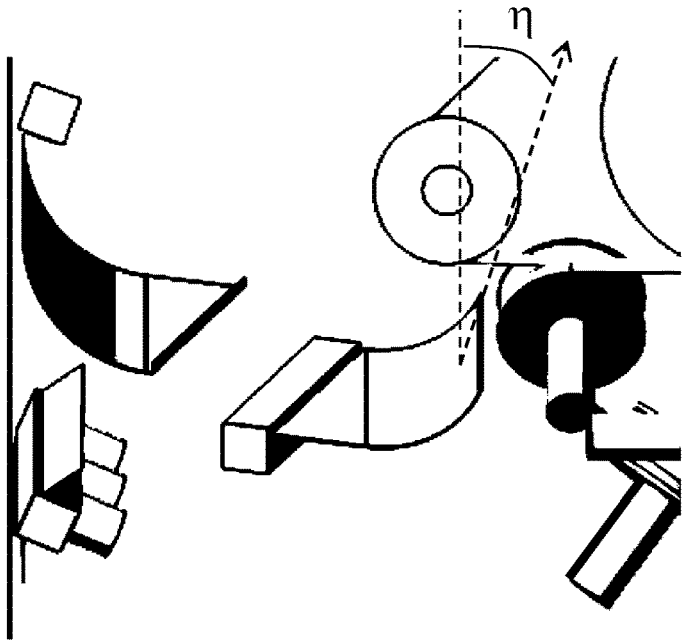

FIGS. 8A and 8B show an embodiment in which the deflection of the latter flow-preventing plate in the machine direction is smaller than 90 degrees, whereby the combined deflection angle of both plates is smaller than 180 degrees. Then, the incidence angle of the tail onto the ropes is also greater than 90 degrees, e.g. 90-135 degrees, which can enhance the reception of the tail. In other words, the angler $\eta$ in the FIG. 8B can be 0-45 degrees. In the other direction, the leaving of the deflection of the flow-preventing plate incomplete causes the fact that an angle $\phi$ is left between the axis of the rope pulley receiving the tail and the direction of the tail of the flow-preventing plate. The angle can be e.g. 0-30 degrees, whereby the 'lacking' diversion of the tail occurs in an air gap remaining between the plate and the pulley.

Suitable incidence angles can be freely provided also otherwise than the shapes and positions of the flow-preventing plates of the first and the second blower.

Instead of a rope nip, the tail-threading apparatus 218 can be some other apparatus suitable for the purpose, such as a vacuum conveyor or even an air-blowing apparatus. Similar to the receiving rope pulley of the rope nip, such another apparatus can also advantageously be inclined in an equivalent way totally or partially around the longitudinal axis of the fibrous-web machine to set it at an optimal angle in relation to the diverted tail according to the invention.

The tail can be cut before feeding it to the rope nip in a way described above e.g. by an air cutting device described in more detail below.

Air Cutting Device

According to a second aspect are introduced a device and a method for manipulating a fibrous web, particularly for its cutting before the above-said. The device comprises at least one blower provided with a flow-preventing element which is arranged to produce at least one blow substantially in the direction of the fibrous web and a friction element against which the fibrous web is arranged to be pressed partially from the effect of said blow and flow-preventing element to apply friction force resisting the motion of the fibrous web to the fibrous web. According to the second aspect of the invention, the blow is directed substantially away from the friction element and the friction element comprises a surface profile which is arranged such that, from the effect of said at least one blow, a continuous vacuum is created on the surface of the fibrous web on the side of the friction element. Due to its intensified friction effect, the device according to the second aspect of the invention is applicable especially for board and, by means of its, it is possible to form e.g. an air cutting device in the tail-threading section of a board machine.

According to an embodiment, the vacuum is arranged to be formed at least mainly between the fibrous web and the friction element. Then, the surface profile of the friction element forms a discontinuous contact with the fibrous web.

According to another embodiment, the surface profile of the friction element comprises several projections against which the fibrous web is arranged to be pressed and between which then remains an air channel for maintaining said vacuum. There can have been arranged projections on the surface of the friction element in two dimensions, as will be later described, or at least in one of these dimensions. The most powerful effect can be provided when there are projections in two directions.

According to a further embodiment, the projections are fastened to a base element which comprises a plate in the direction of the plane of the fibrous web.

In addition to or instead of projections, it is possible to use other surface profile elements which make the surface of the friction element different from a planar one. The surface profile elements can also comprise openings.

In addition to the projections or other surface profile elements keeping the fibrous web partially loose from the surface of the friction element and enabling the creation and continuous maintenance of the vacuum, they can themselves increase the roughness (on micro and/or macro level) of the surface of the friction element, which further intensifies the friction effect.

According to an embodiment, the vacuum is arranged to be created on the opposite side of the friction element than the side on which the fibrous web is pressed to it. Then, there are openings in the friction element via which openings the fibrous web 'is sucked' against the friction element.

According to another embodiment, the object of the invention is an arrangement for tail cutting, which arrangement includes at least two blowers substantially affecting the tail in the opposite direction for cutting the tail, whereby both blowers are provided with flow-preventing plates, and a friction element arranged between the blowers. The friction element is arranged to lift the tail away from the surface of the device such that it forms a discontinuous contact with the tail. According to an advantageous variation described in more detail later, the friction element lets air flow between a common air chamber of the tail and the blowers.

In more detail, an air cutting device according to an embodiment comprises two blowers, i.e. a first blower for producing a first air jet substantially at least mainly against the motion direction of the fibrous web and a second blower for producing a second air jet at least mainly in the motion direction of the fibrous web. A friction element is located in the motion direction of the fibrous web between said first and second blower such that both the first and the second air jet create said vacuum. Both blowers can provide suction from the same space, which intensifies the pressing of the fibrous web against the friction element and thus the friction effect. Such an arrangement is advantageous particularly in an air cutting device, in which the substantially stopping friction effect of the fibrous web is desired in order to enable air cutting. Especially in such a device, the first and the second blower are arranged to produce air jets substantially equal of their intensity.

According to an embodiment, said first and second blower comprise a common air-supply channel and said friction element is arranged substantially between the common air-supply channel and the fibrous web. Such an arrangement enables a particularly small-sized effective air cutting device.

The used blowers are provided with a flow-preventing element the task of which is to limit the supply of make-up air at least from one side of outlet openings, whereby the supply of make-up air from the vicinity of the surface profile of the friction element increases substantially, which causes a vacuum increasing friction according to the invention. Typically, a flow-preventing plate set in the direction of the blow is utilized or one curved away from it and/or set at an angular position. The curved plates and/or ones set at an angular position further cause a force component pressing the fibrous web towards the device at least partially due to the Coanda effect. Particularly, plates set at an angular position in relation to the travel direction of the web can guide the already cut web into a desired direction, because the plates divert the air flow due to the Coanda effect.

Figure 1A:
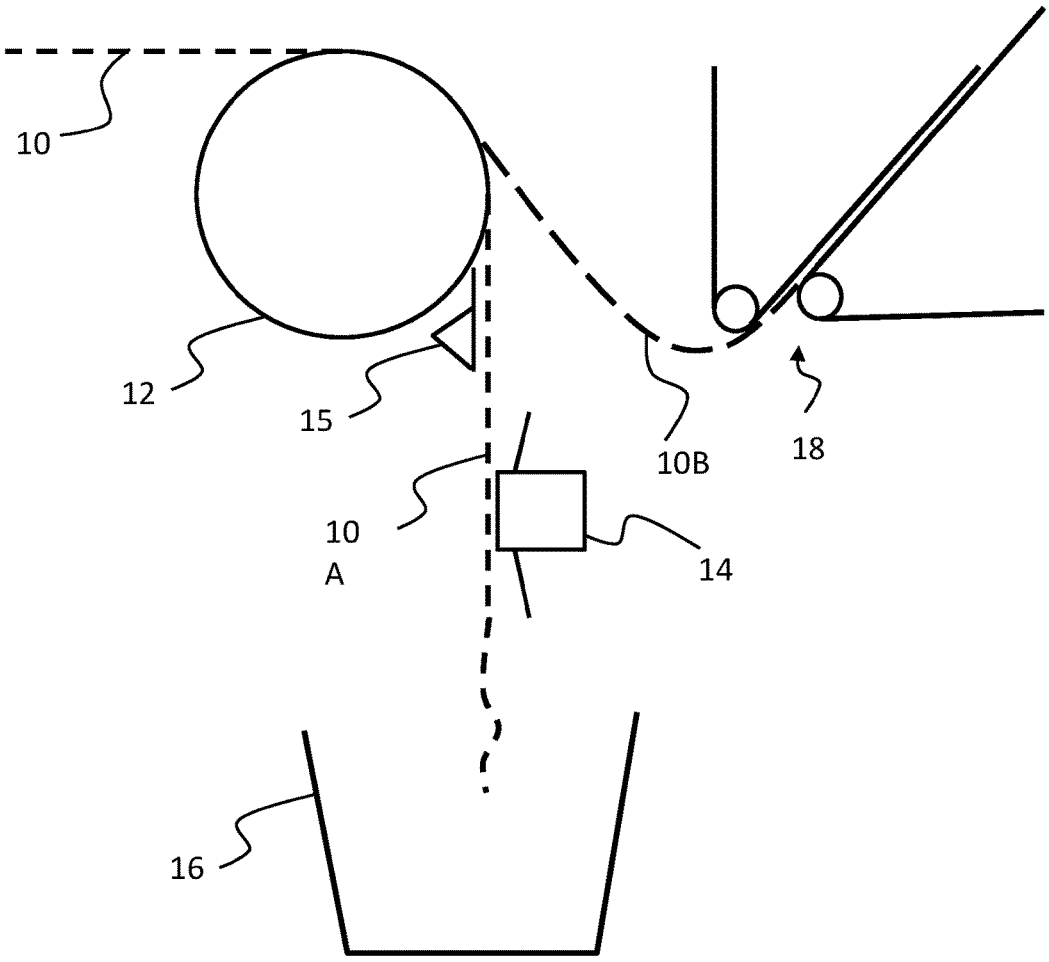
FIG. 1A shows a schematic cross-sectional side view of the basic principle of tail-threading of a fibrous web in a fibrous-web machine utilizing an air cutting device according to a second aspect of the invention.

FIG. 1A shows the basic principle of the tail-threading of a paper or board machine according to a possible implementation utilizing the present invention. A fibrous web 10 is supplied onto a roll 12 from which it falls into a broke-handling device 16, such as a pulper. The web releases from the roll 12 at the latest when hitting a doctor knife 15. A tail 10A has been separated from the web by cutting before the web has released from the roll. An air cutting device 14 according to an embodiment of the invention is located on the front side of the tail 10A close to the falling web.

FIG. 1A also shows the situation after cutting when a tail 10B has been cut by the air cutting device 14 and brought to a rope nip 18 or some other apparatus controllably receiving the tail 10B for guiding it to further processing. Bringing the tail 10A cut in the vicinity of the air cutting device 14 to a receiving apparatus can be implemented e.g. by the method described above by utilizing holding-down and draw-in blows and deflected flow-preventing plates.

Figure 1B:
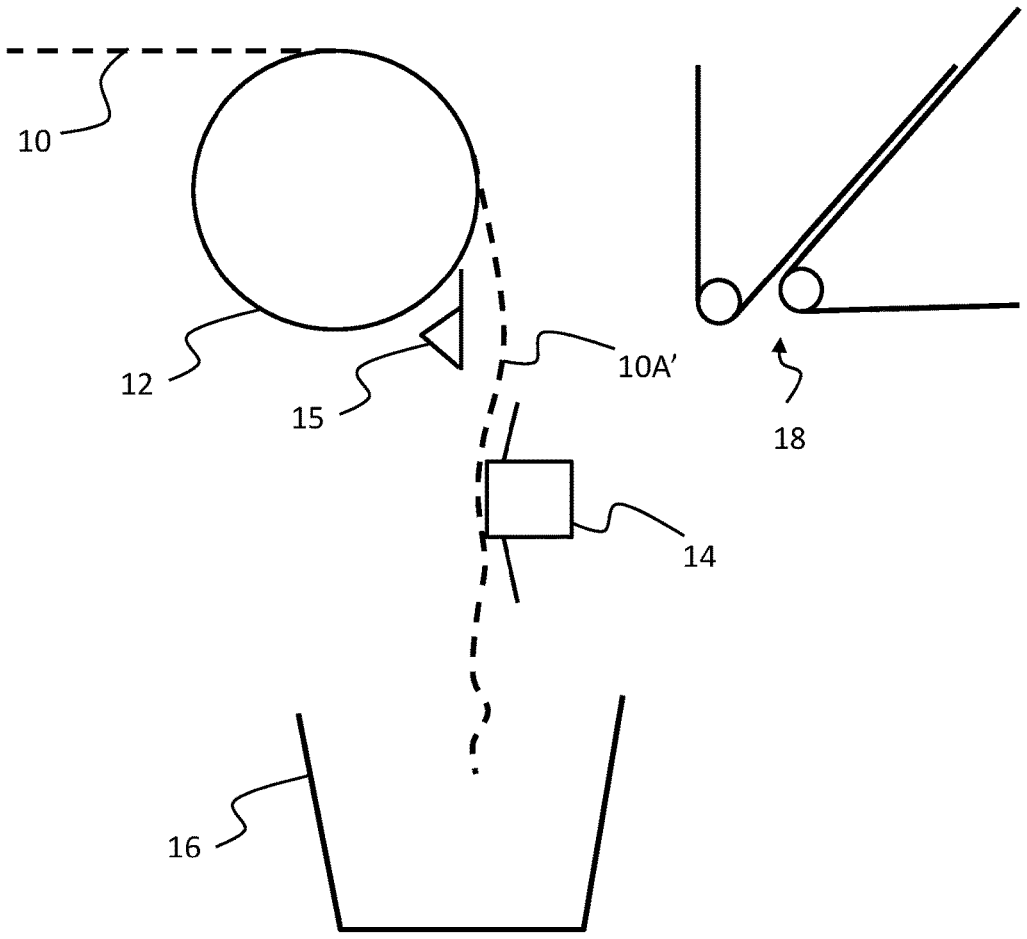
FIG. 1B shows in more detail an air cutting arrangement of a fibrous web according to an embodiment.

FIG. 1B shows an arrangement corresponding to that of FIG. 1A in which, however, the travel of a web 10A', due to the device 14 being in operation, has started to decelerate in the area of the device 14 and thus started to bulge above that towards the further-processing apparatus 18. Hence, FIG. 1B shows an intermediate situation between the positions of the webs 10A and 10B of FIG. 1A.

In FIGS. 1A and 1B, the device is located below the plane of the doctor knife, but it can also be located on its plane or even above it. In more detail, the horizontal centre line of the device in such an arrangement is on the level of the lowest plane of the doctor knife or even on the level of its topmost plane (doctoring plane) or above it.

Next, an air cutting device according to an embodiment will be described in more detail with reference to FIG. 2A. Generally, the device comprises two blowers 21A, 21B i.e. it is arranged to produce two blows 26A, 26B, that is, a cut-off blow 26A and a holding-down blow 26B, of which one, in this case the blow 26B, is directed substantially in the travel direction of the tail 10 and the other, the blow 26A, substantially opposite to the travel direction of the tail 10.

Figure 2A:
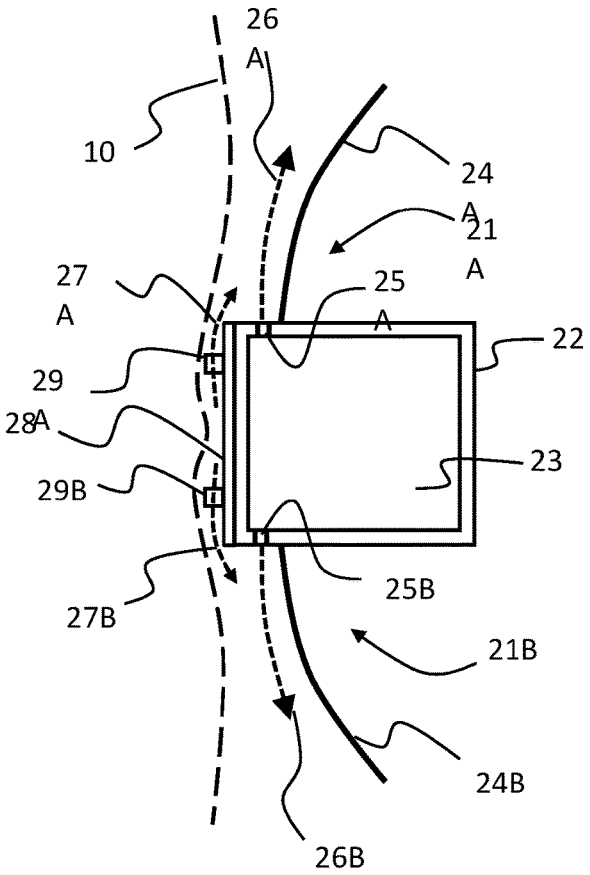
FIGS. 2A and 2B show cross-sectional side views of air cutting devices according to the second aspect of the present invention in accordance with two alternative embodiments.

In more detail, the device illustrated in FIG. 2A comprises a frame 22 which forms an air chamber 23. On the opposite sides of the chamber, for each are arranged one or advantageously several air openings 25A, 25B i.e. nozzles such that, when pressurizing the chamber 23, air jets i.e. cut-off and holding-down blows 26A, 26B, respectively, are formed from the air openings 25A, 25B. Compressed air can be produced e.g. by a compressor (not shown in the figures). Advantageously, the start directions of the air jets 26A, 26B are substantially in the direction of the web 10 and opposite or mainly opposite to each other. An angle between the start directions of the jets can be e.g. 90 . . . 200 degrees, typically 180 degrees. On each side, the air openings 25A, 26B can comprise e.g. a bank of openings in the direction of the web, perpendicular in relation to the plane of FIG. 2A, or equivalently one or more narrow slot-like openings.

Furthermore, the device is provided with flow-preventing plates 24A, 24B which are arranged on the opposite sides of the frame 22, in the vicinity of the air openings 25A, 25B, respectively. The plates 24A, 24B prevent the air jets 26A, 26B from receiving make-up air from an undesired direction and cause suction which pulls the fibrous web 10 towards the plates 24A, 24B and against the device. In this example, the plates 24A, 24B extend away from the air openings 25A, 25B at least partially obliquely in relation to the plane of the fibrous web, whereby they cause the so-called Coanda effect i.e. the curving of air jets 26A, 26B away from the fibrous web. The plates 24A, 24B can be straight or, as shown in FIG. 2A, curved. They can also be angular (straight in bits). The start direction of the plates can be in the direction of the blow or inclined e.g. for 0 . . . 45 degrees in relation to the start direction of the blow.

When the tail 10 is brought to the position according to FIG. 2A, its travel decelerates or it even stops from the effect of two simultaneous and opposite blows, in this case from the effect of the blows 26A, 26B directed at opposite directions, when their strengths are appropriate. The substantial deceleration of the tail 10 leads to its intensive vibration in the flow of the blows, the breaking of fibers and further to the cutting of the whole tail 10. In the case of the present invention, this process occurs in a smaller area in the travel direction of the web compared with previous solutions and thus also extremely quickly and accurately, like described in more detail below.

To intensify the deceleration, stopping and thus also cutting of the web, a friction element 28 has been arranged according to the present invention on the side of the web of the frame 22 in FIG. 2A, in more detail in an area between the blow openings 25A, 25B, against which friction element the web 10 is pressed. The friction element 28 advantageously extends close to the outlet openings and lifts the tail 10 loose from the frame 22 of the chamber 23. The air jets 26A, 26B tend to get make-up air from all possible directions. One direction has been blocked in the arrangement by the flow-preventing plates 24A, 24B. Hence in the present arrangement, make-up air is extracted from a pocket zone formed by the tail 10, the flow-preventing plates 24A, 24B and the walls 22 of the chamber 23 and the friction element 28. By lifting the tail 10 at least partially loose of the chamber 22 by the friction element 28 and by arranging the friction element 28 substantially air permeable in the direction of the plane of the tail 10, the air jets 26A, 26B tend to get make-up air particularly between the tail 10 and the chamber 22. These make-up air flows are illustrated in FIG. 2A by arrows 27A, 27B. Then, at the front of the tail 10 is formed an intensive vacuum which presses the tail strongly against the friction element 28.

As seen in FIG. 2A, the friction element 28 is located totally at the back of the blows 26A, 26B i.e. the blows 26A, 26B are directed away from it. The desired vacuum effect is provided by the make-up air flows 27A, 27B created from the combined effect of the profile of the friction element 28, the blows 26A, 26B and the flow-preventing plates 24A, 24B.

According to an embodiment illustrated in FIG. 2A, the friction element 28 comprises a base plate and projections 29A, 29B extending from the base plate which first come into contact with the tail 10. A wall of the chamber 22 can also operate as the base plate. The projections 29A, 29B are arranged at a distance from each other such that air channels are formed between them (on a plane perpendicular to the one of the figure). Thus, the air jets 26A, 26B cause a continuous vacuum between the friction element and the web, which presses the tail 10 towards the friction element 28 and particularly its projections 29A, 29B more and more intensely. The increasing friction starts to decelerate the run of the tail 10. Finally, the force of the air jets 26A, 26B cuts the tail. If the air jets 26A, 26B are intensive enough, the friction force between the tail 10 and the friction element 28 is sufficient to stop the tail 10.

In the case of the friction element 28 provided with projections, the tail 10 tends to bulge according to FIG. 2A between the projections towards the friction element, which further intensifies the friction effect.

An advantageous way to form the friction element 28 is to manufacture holes directly on the wall of the nozzle chamber 22 or on a separate plate at a distance from each other and to fasten in the holes retainer screws the heads of which form the projections 29A, 29B. Such durable retainer screws are commonly available.

The distance between the projections 29A, 29B can be quite freely arranged. It can be e.g. 5-50 mm from one edge of the projection to that of the other. The height of the projections is advantageously 1-10 mm, typically 1-5 mm.

The vacuum is formed particularly high the tail 10 being wide in relation to the cross-sectional area of the pocket zone (the area between the web, the flow-preventing plate and the chamber) supplying make-up air. With typical tail widths, e.g. 10-40 cm, the vacuum and friction provided with the locations and dimensions of projections described above as examples and the flows of the air jets 26A, 26B provided by conventional techniques are sufficient to enable the cutting of the board solely by the force of the air jets. As the thickness of the board and simultaneously the rigidity of the tail 10 increase, the complete stopping of the tail 10 is advantageous because a short cutting time is then ensured. The increase in the rigidity of the tail 10 increases the force by which the tail is pressed against the friction element and thus also the friction force.

Figure 2B:
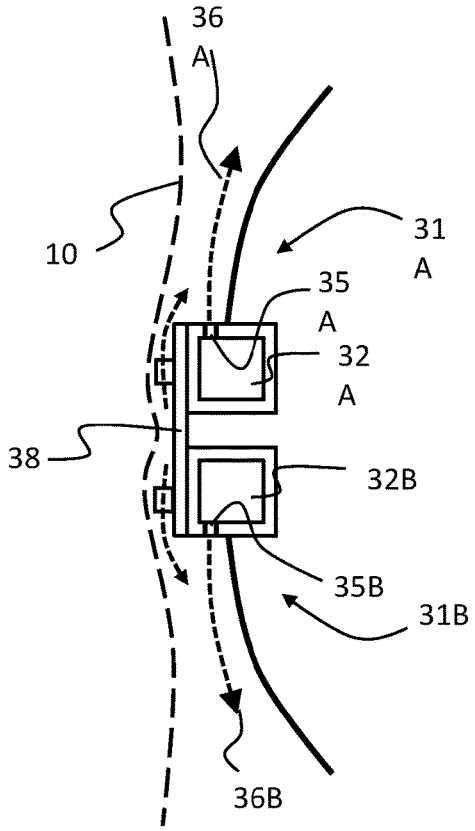

In the embodiment of FIG. 2A, the air openings 25A, 25B on both sides are arranged into connection with the same air chamber 23, which ensures equal jet pressure on both sides. FIG. 2B shows an alternative embodiment in which air openings 35A, 35B are arranged into connection with separate chambers 33A, 33B, respectively. Then, the jet pressure of the air jets 36B, 36A being in the forward and reverse direction with the travel direction of the web, respectively, can be adjusted independent from each other, which can be advantageous in the precise adjustment of the cutting process. The friction element is arranged on the sides of the chambers 33A, 33B on the web side such that it comes in contact with the web and forms a vacuumizing air pocket from the effect of the air jets 36A, 36B. Of its other parts, the arrangement corresponds with the arrangement shown in FIG. 2A.

In the illustrated examples, the chamber 23 (33A, 33B) together with the air openings 25A, 25B (35A, 35B) and the flow-preventing plates 24A, 24B (34A, 34B) form the blowers 21A, 21B (31A, 31B). The production of compressed air and its connection to the chamber 23 (33A, 33B) are not described here in more detail.

The distance of the upper and lower air openings 25A, 25B from each other and thus the dimension of the friction element in the direction defined by the air openings 25A, 25B is advantageously as small as possible, still such that a sufficient vacuumized air pocket and friction effect are provided. Typically, the distance is 2-10 cm.

Figure 2C:
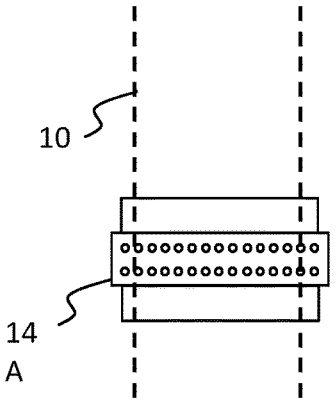
FIGS. 2C-2E show cross sections in the direction of the web plane of various positions of the air cutting device according to the second aspect of the invention in relation to the web in accordance with different embodiments.
Figure 2D:
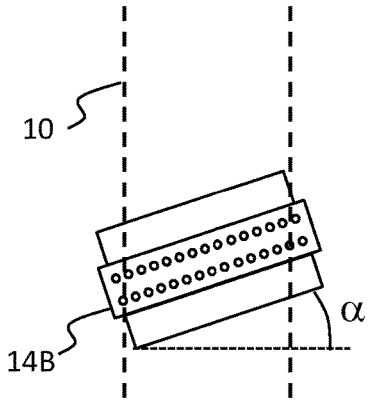
Figure 2E:
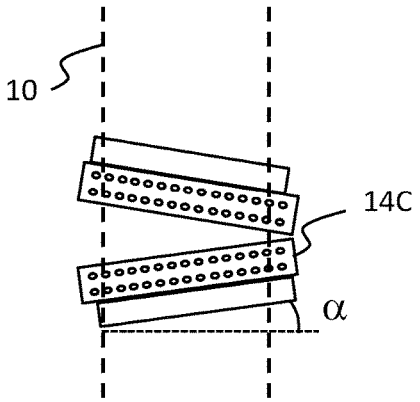

FIG. 2C shows an air cutting device 14A positioned at right angle in relation to the travel direction of the web 10. FIG. 2D shows an air cutting device 14B positioned at an angle $\alpha$ diverted on the plane of the web 10 in relation to the travel direction of the web 10. The angle $\alpha$ can be ±0 . . . 45 degrees. FIG. 2E shows an air cutting device 14C the upper and lower sections of which are positioned both independent from each other (e.g. implemented by a structure similar to the one in FIG. 2B) at an angle α diverted on the plane of the web 10 in relation to the travel direction of the web 10. The angle α can also be in this embodiment ±0 . . . 45 degrees. The diversion of the device or its section on the plane of the web is advantageous e.g. if, after cutting, the tail is wished to be guided aside from its original machine-directional line.

Figure 2F:
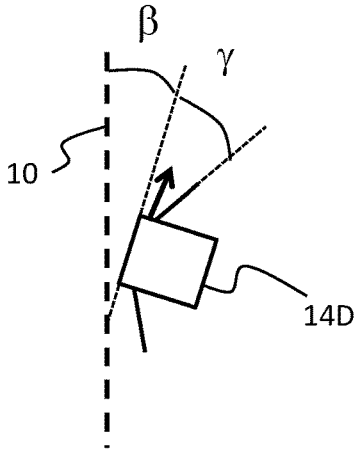
FIG. 2F shows a cross-sectional side view of the position of an air cutting device according to an embodiment in relation to the web and an angle of a flow-preventing plate in relation to a blow start direction.

Furthermore, FIG. 2F shows an arrangement in which an air cutting device 14D has been diverted from the plane of the web (the original income plane of the web) out for an angle β. The angle β can also be ±0 . . . 45 degrees. Such an arrangement is advantageous e.g. when the tail is desired to guide strongly after the cutting by means of an upper blow.

The angular positions in accordance with FIGS. 2C-2F can be freely combined to provide a desired effect without diverging from the idea according to the invention in which the blows are arranged at least mainly in the travel direction of the fibrous web to obtain a desired manipulation effect.

It is sufficient that, in a two-blower arrangement, one of the blows sucks the web fast to the friction element and thus increases kinetic friction between it and the web. The other blow can have been arranged e.g. only for cutting. In a typical arrangement however, both blows take part at least at some stage of the cutting process for both increasing the friction effect and the cutting.

Figure 3A:
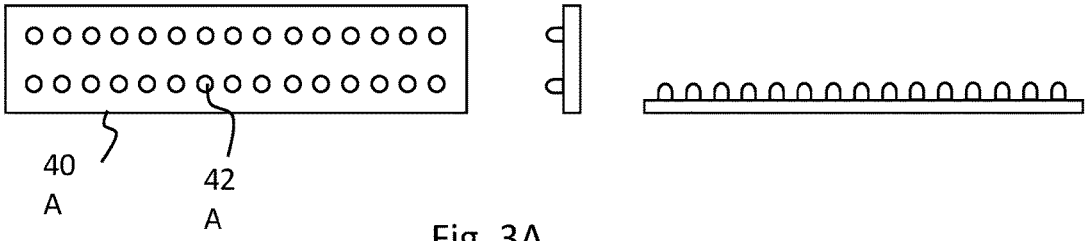
FIGS. 3A-3D show orthogonal cross-sectional views of alternative implementations of a friction element.
Figure 3B:
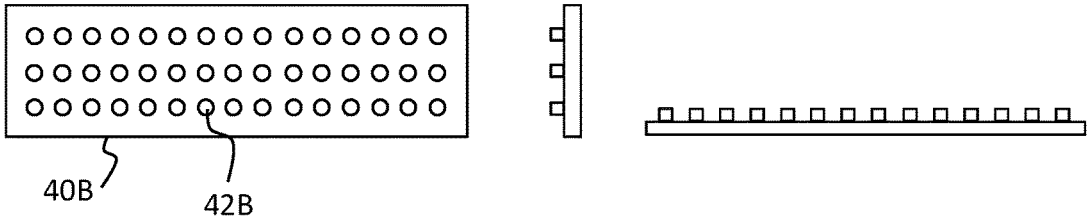
Figure 3C:
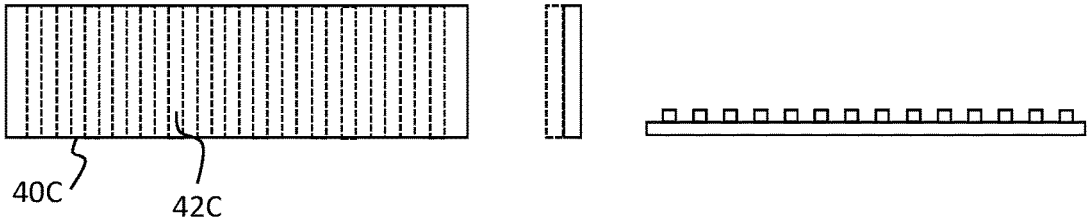

A profile of the friction element providing a desired effect can be formed in many ways and some ways have been illustrated in FIGS. 3A-3D as examples. The arrangement shown in FIG. 3A corresponds with the arrangements shown in FIGS. 2A and 2B. Here, projections 42A are arranged on a base plate, which can also be a wall of the chamber, in two rows at a distance from each other. FIG. 3B shows an equivalent arrangement in which projections 42B are arranged in three rows onto a base plate 40B. FIG. 3C shows an alternative arrangement in which projections 42C comprise elongated elements in the travel direction of the web, whereby several elongated vacuumized air pockets are formed in zones defined by the web, the base plate 40C and the projections 42C.

Figure 3D:
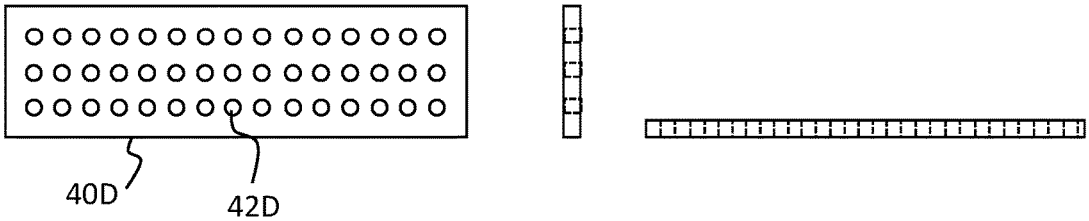

FIG. 3D shows an arrangement different from the previous ones in which openings 42D have been formed on a base plate 40D instead of projections. When such a plate is arranged in accordance with FIG. 4C by means of suitable separator elements 99A, 99B at a distance from the wall of an air chamber 93 of a blower 91 as a friction element 98, a vacuumized air pocket is formed between this and the chamber similar to the previous embodiments. Via the openings 42D, the web tends to be sucked against the base plate 40C and further 'through the openings', whereby friction force increases.

In all of the above arrangement examples, the general form of the friction element is a plane in the direction of the web the detailed profile of which still differs from the planar i.e. even profile. It is possible to combine the above-described arrangements or to construct other arrangements with equivalent effects.

Figure 4A:
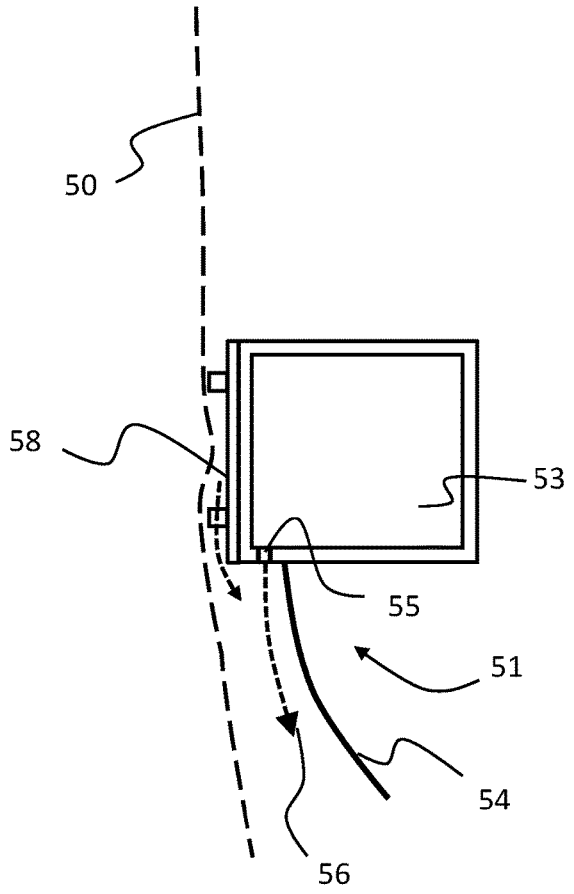
FIGS. 4A-4C show cross-sectional side views of further implementations of the air cutting device.

FIG. 4A shows a 'one-sided' blower device for manipulating a fibrous web 50 but still being according to the invention. Its structure corresponds to that of the device shown in FIG. 2A but it comprises only one blower 51, i.e. air openings 55 and a flow-preventing plate 54, only on one side of a chamber 53 to provide one air jet 56. In this case also, the blower 51 and the friction element 58 provide a desired vacuum effect increasing friction in the range of the friction element 58. Such a device is suitable for e.g. the guiding, deceleration or tightening of board webs.

Figure 4B:
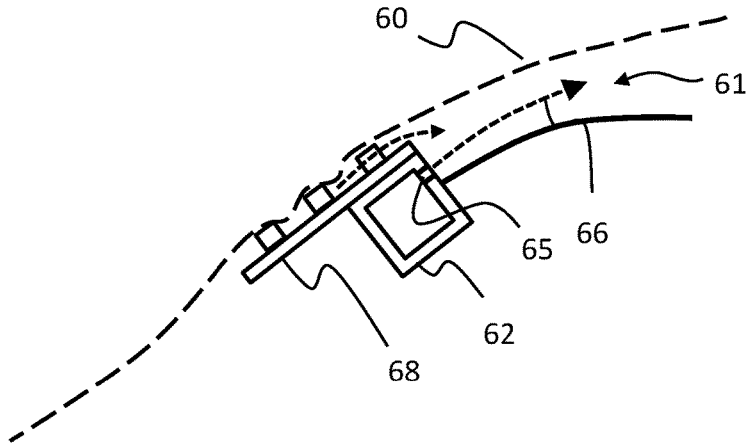
Figure 4C:
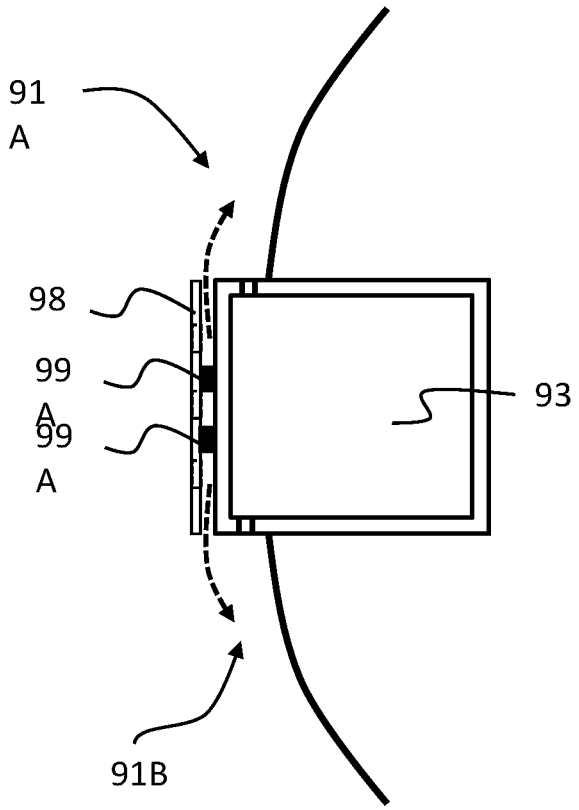

FIG. 4B shows a further variation in which a blower 61 comprises a blowing chamber 62 which is still smaller than a friction element 68 of its dimension in the direction of the web. Here, the friction element 68 is a plate having three rows of projections. An air jet 66 is directed from air openings 65 obliquely in relation to the vertical direction but substantially in the direction of a web 60 to guide, decelerate or tighten it.

As it is evident from the above description, the present invention can be implemented in many different ways only some of which have been depicted here. The device according to the invention can be fitted as part of various tail-conveyance, tail-cutting and/or tail-threading apparatus units, whereby e.g. the strengths of blows can be adjusted and the flow-preventing plates and friction elements shaped according to the requirements of each apparatus.

According to an embodiment, the present manipulating device forms one uniform device unit i.e. its different parts are connected to each other such that the device is easily transferable and positionable at a desired point as one unit.

The width of the device (the dimension in direction of the web width) is typically arranged to correspond to the width of the web to be manipulated or it is slightly larger than that. The width can be e.g. 5 cm-10 m, in the case of the tail typically 5-40 cm.

The supply device or devices of air pressure, such as compressors, connectable to the device and their control units are available prior art for those skilled in the art and they are not discussed here in more detail.

Even though the invention and its embodiments were above described mainly in connection with tail cutting, they can also be used in other stages of the tail-threading process for manipulating the tail or for manipulating other webs, even full-width webs, in the tail-threading section or other sections of the fibrous-web machine.

The invention claimed is:

1. An arrangement in a fibrous-web machine for tail-threading of a fibrous web, the fibrous-web machine comprising a longitudinal axis and a cross-directional vertical plane perpendicular to the longitudinal axis, the arrangement comprising a tail-threading apparatus which is arranged to receive a tail separated from the fibrous web and to guide the tail further to subsequent sections of the fibrous-web machine in the longitudinal direction of the fibrous-web machine, at least one blower which is provided with a flow-preventing plate and arranged to guide the tail towards said tail-threading apparatus to feed the tail to the tail-threading apparatus in a diverted travel direction, whereby said tail-threading apparatus comprises a rope nip for receiving the tail, the rope nip comprising tail-threading ropes which are supported by a rope pulley, whereby the rope pulley is arranged to rotate on a plane in the direction of the longitudinal axis of the fibrous-web machine and oblique in relation to the vertical direction of the fibrous-web machine and arranged to receive the diverted tail in said diverted travel direction, said at least one blower with its flow-preventing plate is arranged to divert the travel direction of the tail simultaneously on the longitudinal vertical plane and the cross-directional vertical plane of the fibrous-web machine substantially to the cross-directional vertical plane of the machine or at the most at an angle of 45 degrees in relation to said vertical plane, forming said diverted travel direction.

2. An arrangement according to claim 1, wherein said at least one blower with its flow-preventing plate is arranged to divert the travel direction of the tail into at least an angular position in relation to both horizontal and vertical directions.

3. An arrangement according to claim 1, comprising at least one first blower which is provided with a first flow-preventing plate and arranged to guide the tail separated from the fibrous web towards the tail-threading apparatus, at least one second blower which is provided with a second flow-preventing plate and arranged to guide said tail from the first blower towards the tail-threading apparatus, whereby the fibrous web is arranged to run at least partially on the lower surface of the first flow-preventing plate and at least partially on the upper surface of the second flow-preventing plate.

4. An arrangement according to claim 3, wherein the first blower and flow-preventing plate are arranged to divert the travel direction of the tail from the vertical direction substantially directed from the top downwards to substantially horizontal and at an angle in relation to the longitudinal axis of the fibrous-web machine, and the second blower and flow-preventing plate are arranged to divert the travel direction of the tail further substantially on a plane in the cross direction of the fibrous-web machine and at an angle opening obliquely upwards.

5. An arrangement according to claim 1, wherein the shape of the flow-preventing plate of said at least one blower corresponds to that of a deflected planar plate and the tail has been arranged to run substantially following the surface of the flow-preventing plate.

6. An arrangement according to claim 1, wherein said at least one blower with its flow-preventing plate is arranged to divert the travel direction of the tail from the substantially downwards directed direction at an angle opening upwards for 30-60 degrees in relation to the horizontal direction when seen in the cross-directional vertical plane of the machine.

7. An arrangement according to claim 1, wherein said at least one blower with its flow-preventing plate is arranged to divert the travel direction of the tail from the substantially downwards directed direction at an angle opening upwards for 135-180 degrees when seen on the longitudinal vertical plane of the machine.

8. An arrangement according to claim 1, wherein said tail-threading apparatus is arranged to divert the travel direction of the received tail further substantially into the longitudinal axis of the fibrous-web machine, and to rotate the tail around said longitudinal axis substantially onto horizontal plane.

9. An arrangement according to claim 1, wherein a rotation axis of said rope pulley is located on the cross-directional vertical plane of the fibrous-web machine and is at an angular position in relation to horizontal plane.

10. An arrangement according to claim 1, wherein said at least one blower with its flow-preventing plate is arranged to cause a lateral displacement of the centre line of the tail, the magnitude of which is at least 5 cm, before receiving the tail in the tail-threading apparatus.

11. A tail-threading apparatus for receiving a cut tail in the tail-threading section of a fibrous-web machine having a longitudinal direction, a horizontal cross-direction and a vertical cross-direction, and in which the fibrous web is adapted to move in a machine direction perpendicular to a cross machine direction, the apparatus comprising means for receiving the tail substantially at an angular position in relation to the longitudinal direction and/or horizontal cross-direction and/or vertical cross-direction of the fibrous-web machine, and diverting the travel direction of the received tail substantially into the machine direction, wherein said means for receiving the tail and diverting the travel direction of the received tail substantially into the machine direction comprise a rope nip the tail-threading ropes of which are supported by a rope pulley being arranged to rotate on a plane in the longitudinal direction of the fibrous-web machine and oblique in relation to the vertical direction and being arranged to receive the tail when the tail is substantially on the vertical plane in the cross machine direction or on a plane diverting from this at most by 45 degrees and when the tails is at an oblique angular position in relation to the vertical and horizontal cross-directions of the machine.

* * * * *